US006977017B2

(12) United States Patent
Harchekar et al.

(10) Patent No.: US 6,977,017 B2
(45) Date of Patent: Dec. 20, 2005

(54) CU-ZN-A1(6%) SHAPE MEMORY ALLOY WITH LOW MARTENSITIC TEMPERATURE AND A PROCESS FOR ITS MANUFACTURE

(75) Inventors: Vijay Rajaram Harchekar, Chandigarh (IN); Madanlal Singla, Chandigarh (IN)

(73) Assignee: Council of Scientific & Industrial Research, New Delhi (IN)

( * ) Notice: Subject to any disclaimer, the term of this patent is extended or adjusted under 35 U.S.C. 154(b) by 388 days.

(21) Appl. No.: 10/051,877

(22) Filed: Oct. 25, 2001

(65) Prior Publication Data

US 2003/0079814 A1 May 1, 2003

(51) Int. Cl.[7] ..... C22C 9/04; C23K 1/00
(52) U.S. Cl. ..... 148/402; 420/478
(58) Field of Search ..... 148/402; 420/478

(56) References Cited

U.S. PATENT DOCUMENTS

| | | | | |
|---|---|---|---|---|
| 4,036,669 A | * | 7/1977 | Brook et al. | 148/563 |
| 4,398,969 A | * | 8/1983 | Melton et al. | 75/235 |
| 4,472,213 A | * | 9/1984 | Tabei et al. | 148/402 |
| 4,554,027 A | * | 11/1985 | Tautzenberger et al. | 148/514 |
| 4,750,953 A | * | 6/1988 | Tabei | 148/402 |

OTHER PUBLICATIONS

Wayman, C.M., "Some Applications of Shape–Memory Alloys", Journal of Metals, 32 (Jun. 1980), pps. 129–137.

Michael A.D. & Hart, W.B., "SME Brass—A New Engineering Material", Metall. Material. Technol., vol. 12 (1980), pps. 434–440.

White, S.M., Cook, J.M. & Stobbs, W.M., The Grain Size Dependence of The Loading and Reversion Behaviour of A Cu–Zn–A1 Marmem Alloy Deformed Below Mf, Journal De Physique, C4 (ICOMAT–82), pps. 779–783.

Golestaneh, Ahmad A., "Shape–Memory Phenomena", Physics Today, (Apr. 1984), pps. 62–70.

Saburi, T., Wayman, C.M., Takala, K. & Nenno, S., "The Shape Memory Mechanism in 18R Martensitic Alloys", Acta Metallurgica (Jan. 1980), vol. 28, pps. 15–32.

Schetky, L. McDonald, "Shape–Memory Alloys", Scientific American, 241 (Nov. 1979), pps. 68–76.

Adnyana, Dewa N., "A Copper–Based Alloy For Shape Memory Wires and Springs", Wire Journal International, (1984), pps. 52–61.

Ikai, Y., Murakami, K & Mishima, K., "Stability of the Shape Memory Effect—Effect of Grain Size Refinement", Journal De Physique, Cr (ICOMAT–82), pps. 785–789.

Enami, K., Takimoto, N. & Nenno, S., "Effect of the Vanadium Addition on the Grain Size and Mechanical Properties of the Copper–Aluminium–Zinc Shape Memory Alloys", Journal De Physique, C4 (ICOMAT–82), pps. 773–778.

Higgins, Raymond A., "Copper and the Copper–Base Alloys", Engineering Mettalurgy, vol. 1, (1971), pps. 312–323.

West, E. G., "Copper and Its Alloys", Ellis Horwood Ltd. Series in Industrial Metals, 1962, pps. 98–105.

Greaves, Richard Henry & Wrighton, Harold, "Practical Microscopical Metallography", Chapman & Hall Ltd., (1971), pps. 164–167.

* cited by examiner

*Primary Examiner*—George Wyszomierski
(74) *Attorney, Agent, or Firm*—Mathews, Shepherd, McKay, Bruneau, P.A.

(57) ABSTRACT

The present invention provides for Cu—Zn—Al(6%) alloy and an improved process to lower the martensitic transformation temperature, by a low temperature re-betatising treatment from 110° C. to 30° C. i.e. a lowering of 80° C. wherein previously high temperature betatised material has been subjected to re-betatising at lower temperature in order to utilize the material suitably.

4 Claims, 8 Drawing Sheets

PROCESS FLOW SHEET

MICROSTRUCTURES

1.BETATISED 750°C/3Min./CWQ

2.BETATISED 750°C/3Min /CWQ

MICROSTRUCTURES

1.REHEAT 200°C/10 Min./CWQ

2.REHEAT 300°C/10Min./CWQ

3.REHEAT 400°C/10Min./CWQ

4.REHEAT 500°C/10Min./CWQ

5 REHEAT 600°C/10Min./CWQ

6 REHEAT 700°C/10 Min /CWQ

MICROSTRUCTURES

7.REBETATISED 550°C/10Min./CWQ

8.REBETATISED 575°C/10 Min./CWQ

9.REBETATISED 600°C/10Min./CWQ

10. REBETATISED 625°C/10Min./CWQ

11.REBETATISED 650°C/10Min./CWQ

12.REBETATISED 675°C/10Min /CWQ

13 REBETATISED 700°C/10 Min /CWQ

SME: SHAPE MEMORY EFFECT
CWQ: COLD (ORDINARY) WATER QUENCHED

CU-ZN-A1(6%) SHAPE MEMORY ALLOY WITH LOW MARTENSITIC TEMPERATURE AND A PROCESS FOR ITS MANUFACTURE

FIELD OF INVENTION

The present invention relates to Cu—Zn—Al(6%) shape memory alloy having a low martensitic transformation temperature and a process of lowering the martensitic transformation temperature.

BACKGROUND AND PRIOR ART OF THE INVENTION

Cu—Zn—Al Shape Memory Effect (SME) alloys are promising smart and intelligent engineering materials. (Wayman C. M., Journal of Metals, 32 (June 1980), p-129–137 and Michael A. D & Hart W. B Metal Material Technology, 12(1980), p-434–440. These have attracted much attention because of their low cost and ease of fabrication relative to nitinol (White S. M., Cook J. M. & Stobbs W. M, Journal De Physique, C4 (ICOMAT-82), P-779–783. But nitinol has superior properties, long fatigue life and is biocompatible.

There are about twenty elements in the central part of the periodic table Golestaneh A. A., Physics Today, (April 1984), p-62–70 whose alloys exhibit shape memory like Ag—Cd, Au—Cd, Cu—Al—Ni, Cu—Al—Mn, Cu—Au—Zn, Cu—Sn, Cu—Au—Sn, Cu—Zn, Cu—Zn—Al, Cu—Zn—Sn, Cu—Zn—Ga, Cu—Zn—Si, In—Ti, Ni—Al, Ni—Ti, Fe—Pt, Fe—Pd, etc. (Wayman C. M., Journal of Metals, 32 (June 1980), p-129–137 and Michael A. D & Hart W. B Metal Material Technol., 12(1980), p-434–440.

Shape memory alloys (SMA) have a unique property i.e. these materials remember their past shapes/configurations. The Important characteristics of these alloys are their ability to exist in two distinct shapes or configurations above or below a certain critical transformation temperature. It undergoes diffusionless martensitic transformation Golestaneh A. A., Physics Today, (April 1984), p-62–70, which is also thermo elastic in nature i.e. below the critical temperature a martensitic structure forms and grows as the temperature is lowered, whereas, on heating the martensite shrinks and ultimately vanishes.

The martensite in shape memory alloys is soft in contrast to martensite of steels. Deformation of these alloys is not by slip, twinning or grain boundary sliding but by growth or shrinkage of self-accommodating, multi-oriented martensitic plates/variant Saburi T., Wayman C. M, Takala K & Nenno S., Acta Metallurgica (January 1980) P-15.

On heating, the strained martensite reverts back to its parent phase, thereby, the original undeformed shape is recovered. The change in structure can be linked with change in shape and dimensions and the alloy exhibits a memory of high and low temperature shapes. There is a usable force associated with these shape changes and thus the alloys can be incorporated into range of temperature sensitive devices for warning, control, detection, regulation etc. The actuators can be calibrated to operate within a narrow temperature range by incorporating a compensating bias spring. The recoverable strain is 2–8% and is dependent upon one or two way memory. Copper based shape memory alloys in addition to one-way memory also exhibit two-way memory behavior, after undergoing a suitable thermal-mechanical processing called training (Wayman C. M., Journal of Metals, 32 (June 1980), p-129–137 and Michael A. D & Hart W. B Metal Material Technol., 12(1980), p-434–440.

Once trained, the material will spontaneously change its shape when heated or cooled, above or below the respective transformation temperatures. Forward and reverse martensitic transformation temperatures are designated as 'Ms' (while cooling) and 'As' (while heating) respectively.

In Cu—Zn—Al ternary alloys, shape memory effect lies in the Copper rich corner of the triangle in the form of a trapezium. On enlarging this trapezium we can correlate composition with martensitic transformation temperature Schetky L. M., Scientific American, 241 (November 1979), p-68–76.

The amount of Aluminum varies from 4–10%, Zinc from 10–30% and balance is Copper. Martensite formation temperature ('Ms') varies from −100° C. to +300° C. as a result of very small change in composition. But useful range for Aluminum brass is −70° C. to +150° C.

Martensitic transformation temperature (As) is extremely sensitive to composition. A slight variation of either of the elements, Zinc or Aluminum (say ±0.5%) shifts the transformation temperature by ±50° C. Therefore close control of composition is utmost essential to get the desired transformation temperature for the actuator to work at a specific temperature. Loss of low melting and volatile elements like Al, Zn etc. while melting cannot be avoided in air melting furnaces. Vacuum melting furnaces, in which close control of composition is possible but their installation is extremely costly and are unaffordable to the small and medium scale melting units/industries.

In air melting furnaces, there is always a danger of loss of such elements inspite of compensating these losses and following the necessary precautions rigidly during melting. The alloy with off-composition and undesired martensitic transformation temperature has to be rejected or remelted. The efforts & inputs, thus put in, go waste. It was also observed that loss of zinc or aluminum raises the martensitic transformation temperature whereas increase of these elements lowers the transformation temperature.

Hence, the present invention is directed towards increasing or decreasing of martensitic transformation temperature.

In Cu—Zn-4% Al alloy Adnyana D. N., Wire Journal International, (1984), P-52–61, lowering of martensitic transformation temperature has been comparatively low i.e. around 20° C.–25° C.

There is always evaporation of volatile and low melting elements like zinc, aluminum, tin, lead etc during the melting of copper base and other alloys, especially in the air melting furnaces. These losses cannot be avoided but can be minimized by taking all the care during melting, adding precisely weighed quantities of each element, compensating for the elemental losses and rigidly following precautions during melting.

Vacuum furnaces precisely control these losses but their installations are costly and are thus unaffordable to the small and medium scale melting/foundry units. Cu—Zn—Al shape memory alloys (SMA's) are no exceptions to these. The martensitic transformation temperature (As) is an important parameter in shape memory alloys and is extremely sensitive to the composition. A slight variation of either zinc or aluminum (±0.5%), as a result of melting losses, shifts the martensitic transformation temperature by ±50° C. The material thus cast and processed reduces to a scrap & has to be remelted thereby resulting in wastage of efforts, manpower and machinery.

Experimental studies show that it is possible to raise As temperature by 15° C.–20° C. by the use of either a compensating bias spring or by selective etching/leaching out of zinc by thermal treatments. But lowering of As temperature, once obtained poses problems.

U.S. Pat. No. 4,634,477 recites about shape memory alloys. However, this patent does not mention about the reduction in martensitic temperature.

OBJECTS OF THE PRESENT INVENTION

The main object of the present invention is to provide a shape memory alloy having a composition of Cu—Zn—Al (6%) with lower martensitic temperature.

Another object of the present invention relates to provide a shape memory alloy having good memory response.

Yet another object of the present invention is to provide a shape memory alloy having good recovery and fatigue life properties.

Still another object of the present invention is to provide a shape memory alloy the can prevent quench cracks.

Another object of the present invention is to provide a process for lowering the martensitic transformation temperature (As) of a shape memory alloy having a composition of Cu—Zn—Al (6%)

Yet another object of the present invention is to provide for an improved process, in order to lower the transformation temperature, by a low temperature re-betatising treatment from 110° C. to 30° C. i.e. a lowering of 80° C.

SUMMARY OF THE PRESENT INVENTION

The present invention relates to a shape memory alloy having a composition of Cu—Zn—Al (6%) with lower martensitic temperature. The present invention also relates to a process of lowering martensitic temperature of said alloy by selecting material of composition 74.4% copper, 19.5% Zinc & 6.1% Aluminum and having an 'As' temperature of 110° C.–112° C. is selected. In this process the previously high temperature betatised material has been subjected to re-betatising at lower temperature in order to utilize the material suitably.

DETAILED DESCRIPTION OF THE PRESENT INVENTION

Accordingly the present invention provides for a shape memory alloy having a low martensitic transformation temperature, said alloy comprising Copper and Zinc in the range of 62–86% of Copper and 10–28% of Zinc along with 6% of Aluminum.

An embodiment of the present invention where in said alloy having a martensitic transformation temperature lowered by about 80° C.

Another embodiment of the present invention, wherein said alloy displays good shape memory at a re-betatising temperature of about 575° C.

Yet embodiment of the present invention, wherein said alloy having good fatigue properties thereby preventing quench cracking.

Still another embodiment of the present invention, wherein said alloy once processed can be utilized for some other temperature device or application.

Further another embodiment of the present invention, wherein said alloy having good shape memory response properties.

The present invention also provides for a process for lowering the Martensitic Transformation Temperature(As) of shape memory alloy as claimed in claim 1, by a re-betatising treatment of previously high temperature betatised material, said process comprising the following steps of:

(i) selecting an alloy comprising Copper and Zinc in the range of 62–86% of Copper and 10–28% of Zinc along with 6% of Aluminum;

(ii) melting alloy composition in an induction furnace operating in air under charcoal cover followed by casting into desired shapes;

(iii) homogenizing the above composition at 800° C. for a period of about two hours followed by cooling;

(iv) surface machining for removing oxide scale formation;

(v) analyzing the alloy composition (vi) re-heating the shaped material at about 575° C. for about three minutes;

(vii) quenching said material with cold water;

(viii) obtaining a fully martensitic structure;

(ix) identifying the soft shape memory material with martensitic structure; and (x) recording the temperature and structure of the material;

An embodiment of the present invention, wherein the martensitic transformation temperature (As) is lowered by about 80° C.

Another embodiment of the present invention, wherein the loss of Zinc or Aluminum raises the martensitic transformation temperature whereas increase of these elements lowers the transformation temperature.

Yet another embodiment of the present invention, wherein material once cast and processed can be utilized for some other temperature device or application.

Still another embodiment of the present invention, wherein shape memory response properties are not affected.

Yet another embodiment of the present invention, wherein the two-step betatising and resultant lowering of transformation temperature is valid for higher Aluminum content of 6–10% shape memory alloys.

BRIEF DESCRIPTION OF THE ACCOMPANYING PROCESS FLOW SHEETS METALLOGRAPHS, BAR CHARTS AND CURVES

Figure 5:
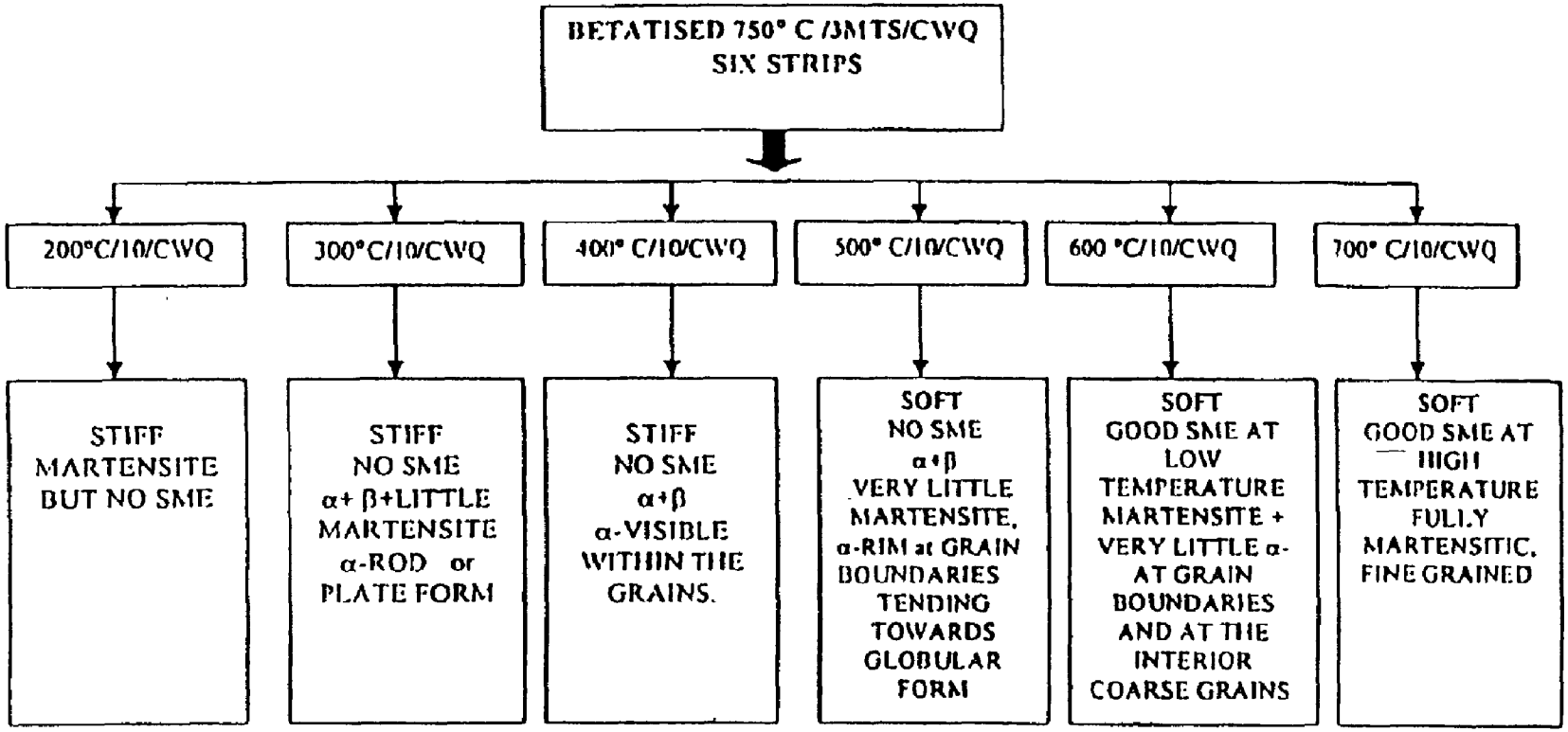

FIG. 5 Flow diagram explains in details the condition of material, its microstructure and shape memory response on heating the previously high temperature betatised material at 200° C., 300° C., 400° C., 500° C., 600° C. & 700° C.

Figure 6:
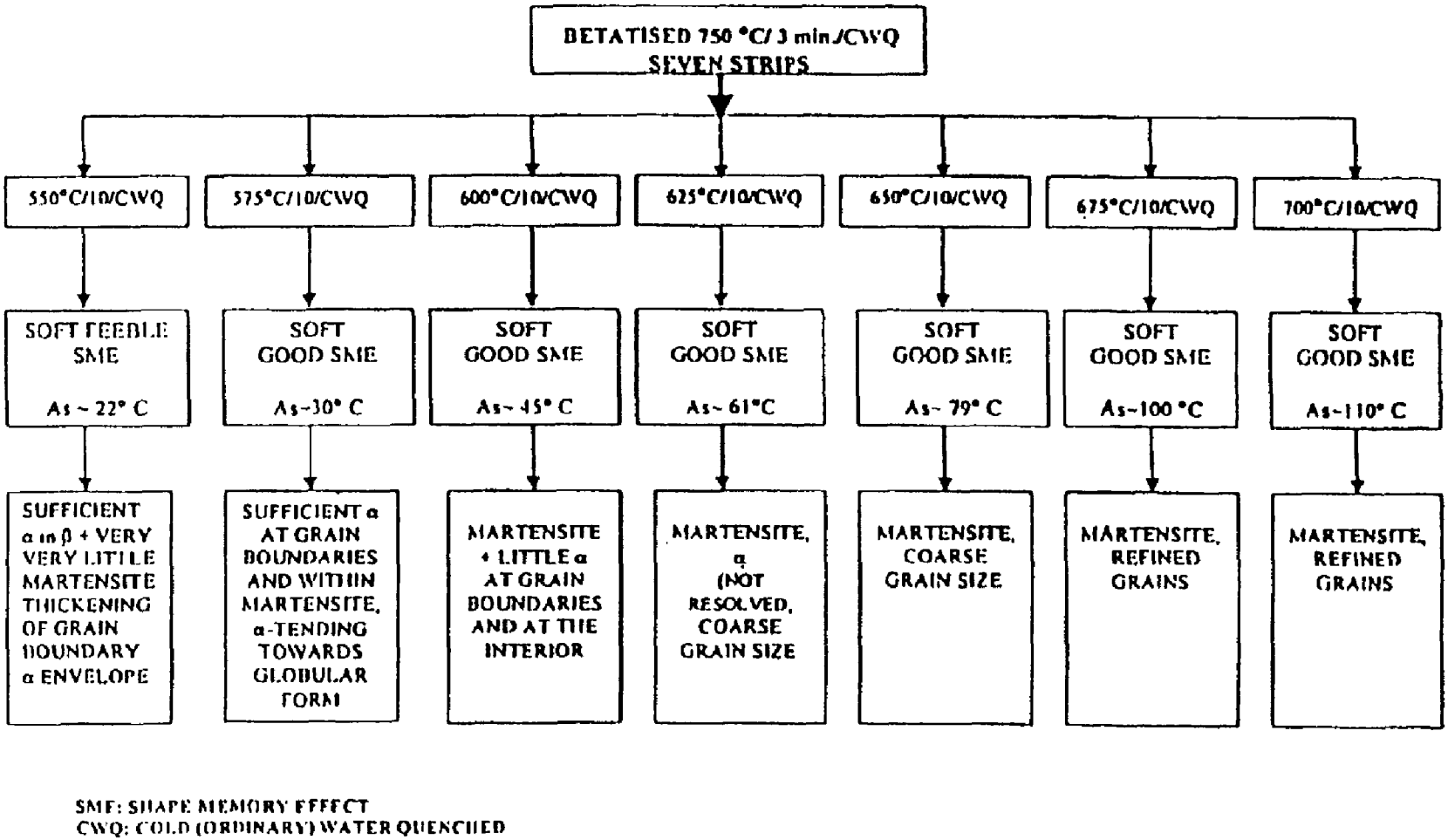

FIG. 6 Flow diagram explains in details the condition of material, its SME response, martensitic transformation temperature (As) and its microstructure on low temperature re-betatising of the previously high temperature betatised material at 550° C., 575° C., 600° C., 625° C., 650° C., 675° C. & 700° C.

Figure 7:
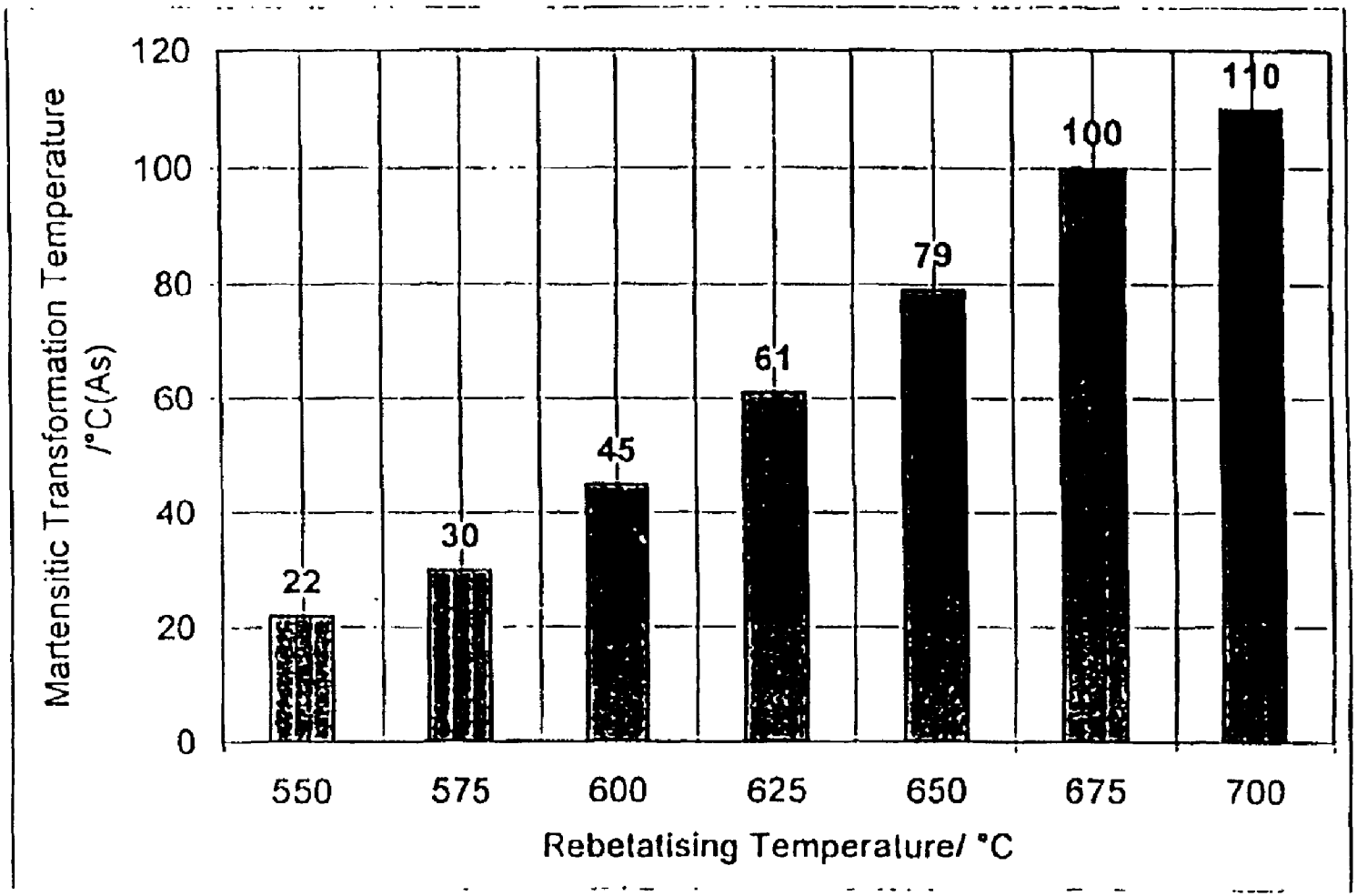

FIG. 7 shows bar chart explaining re-betatising temperature Versus martensitic transformation temperature (As).

Figure 8:
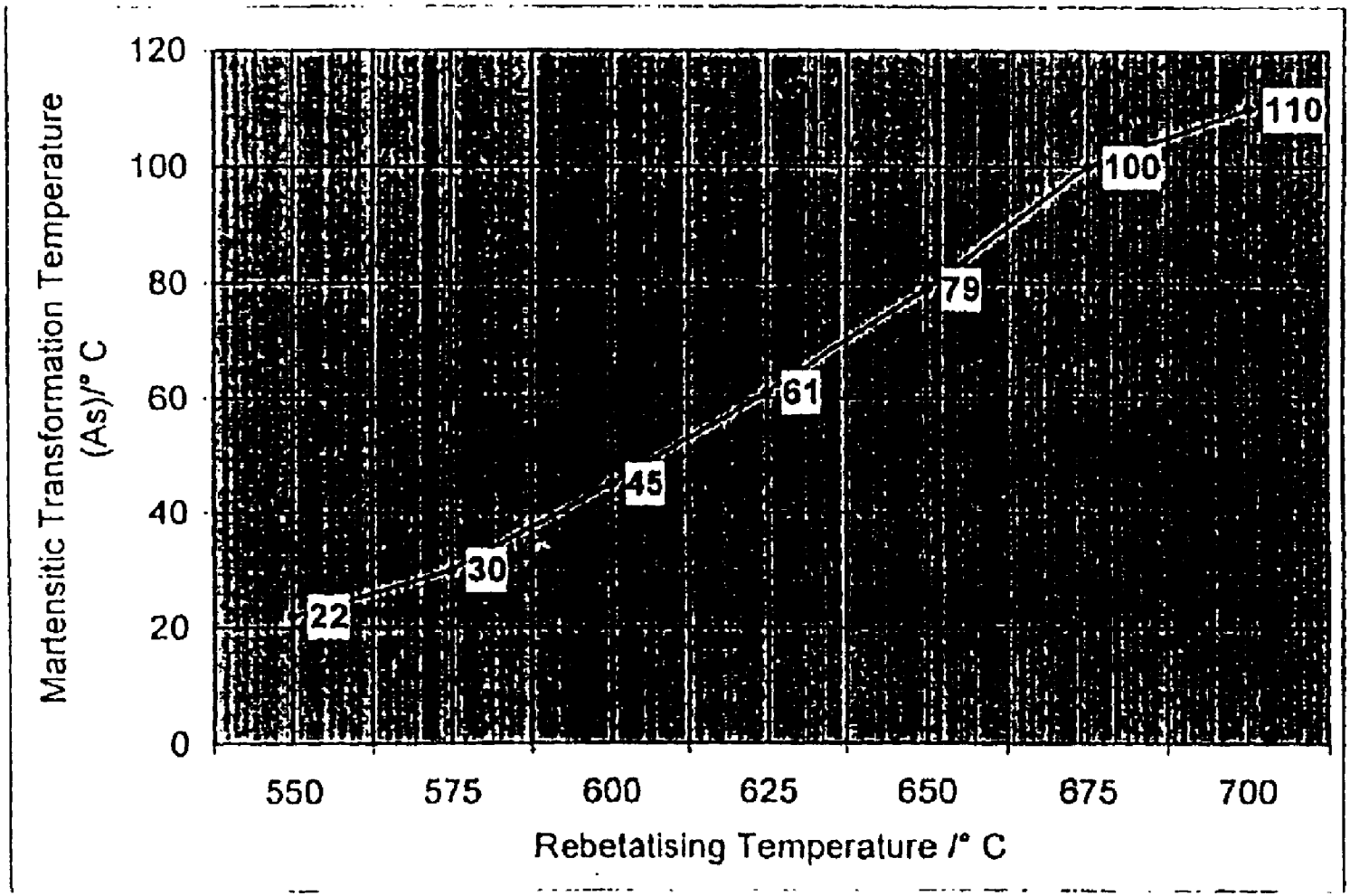

FIG. 8 shows the curve explaining re-betatising temperature versus martensitic transformation temperature. It also depicts optimum lowering of martensitic transformation temperature (As 80° C.) on re-betatising at 575° C.

EXAMPLES

The following examples are provided to illustrate further the invention. However, the same shall not be considered to limit the scope of the invention.

Example 1

Figure 1:
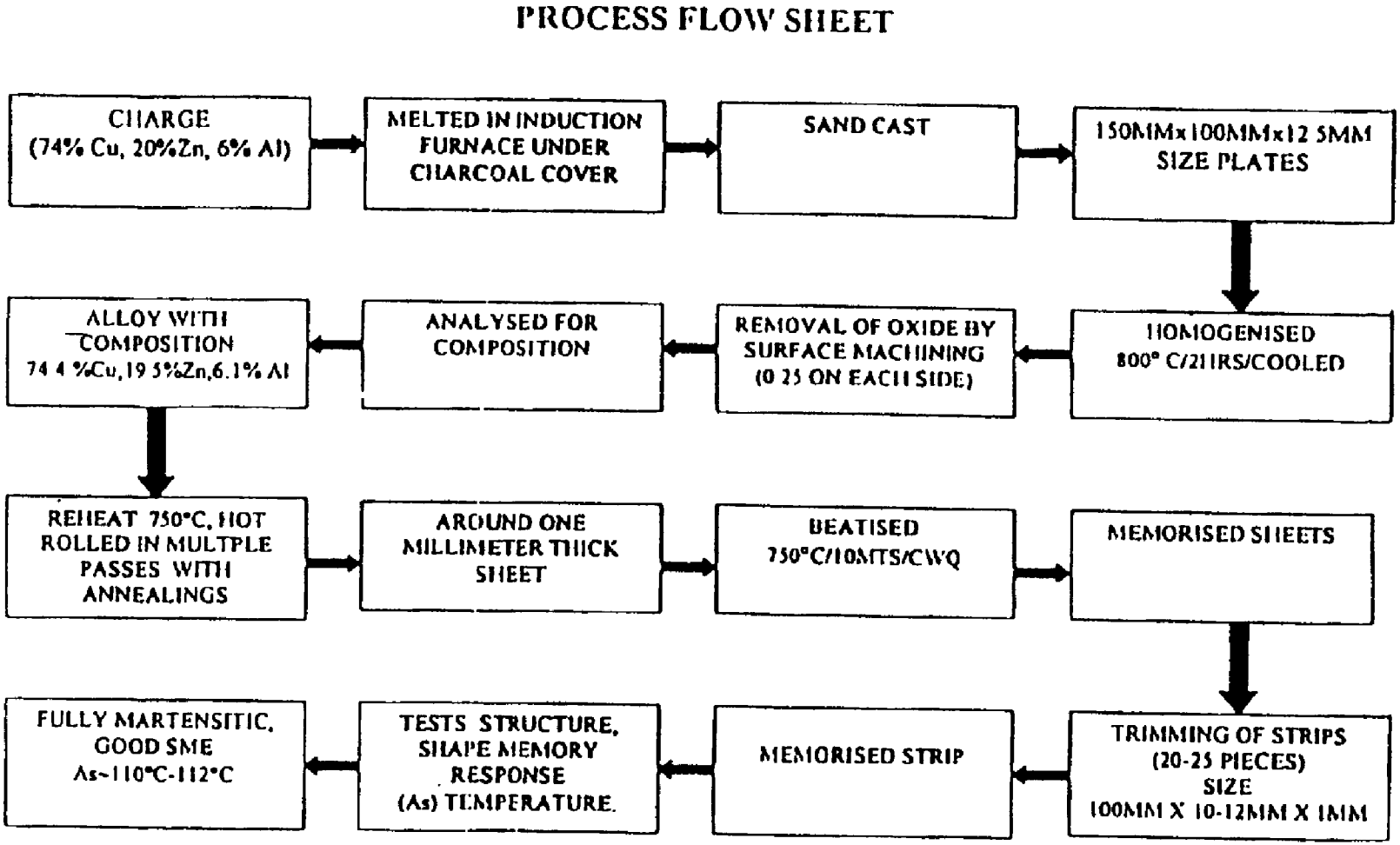
FIG. 1 Shows experimental flow sheet of the process of production of Shape memory alloy in the sheet form and its betatising (memorizing) heat treatment It also depicts its structure, SME response & martensitic transformation temperature.
Figure 2:
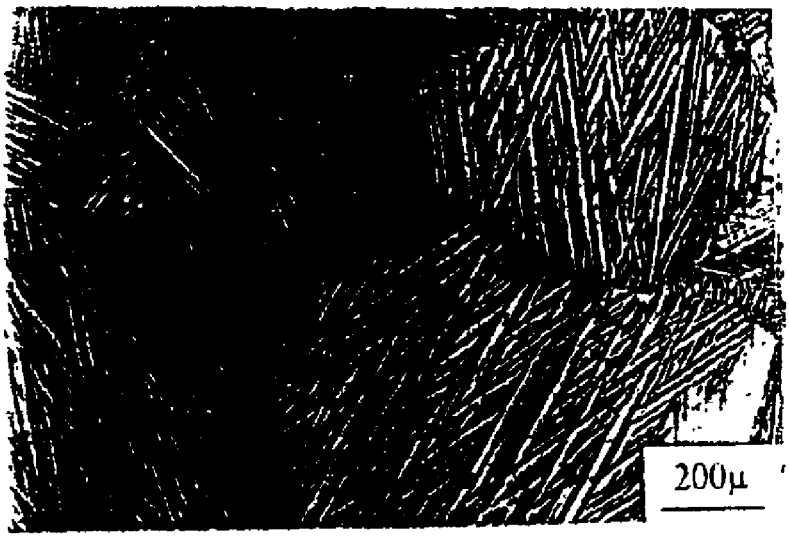
FIG. 2 Depicts microstructures of material betatised at 750° C./3 min/CWQ.
Figure 2:
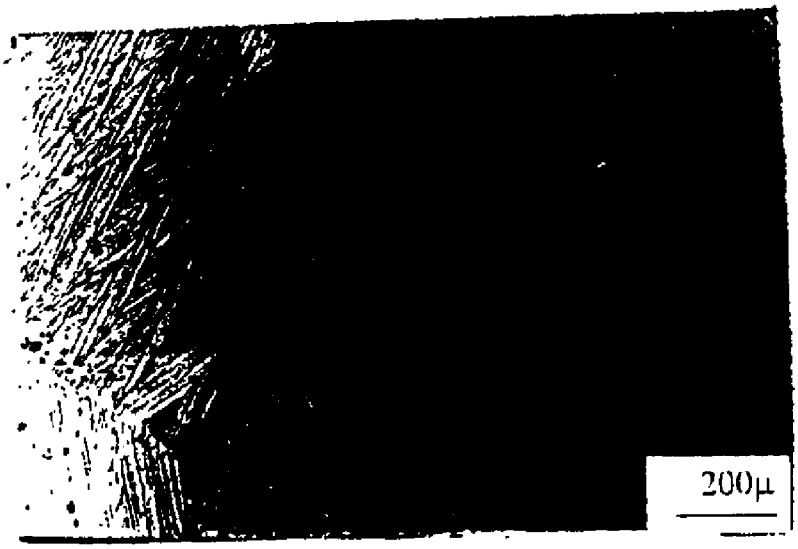
Figure 3:
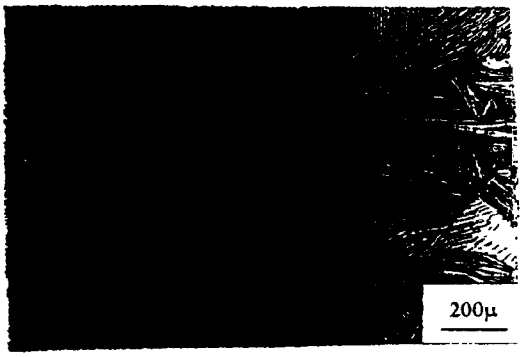
FIG. 3 Depicts microstructures on heating the betatised material at various temperatures like 200° C., 300° C., 400° C., 500° C., 600° C. & 700° C.
Figure 3:
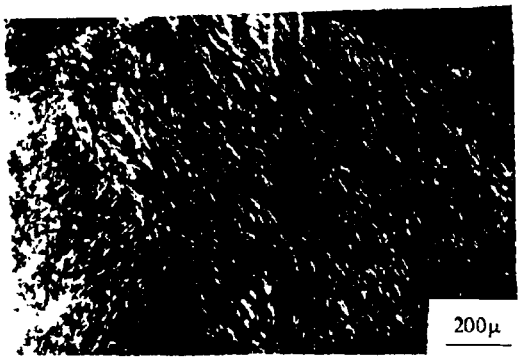
Figure 3:
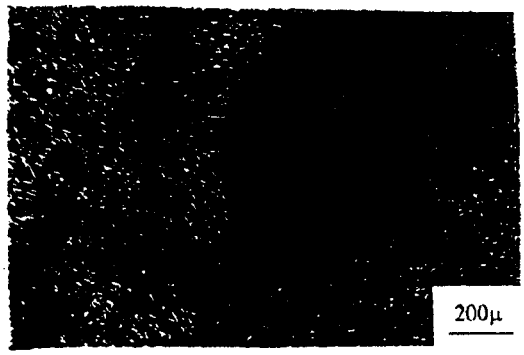
Figure 3:
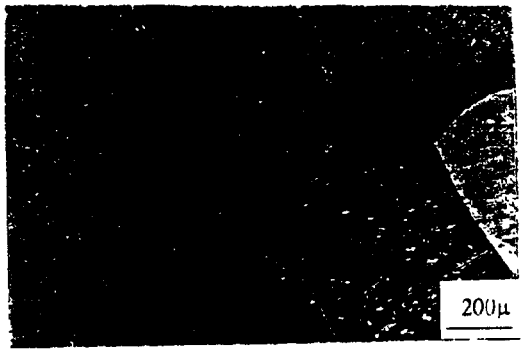
Figure 3:
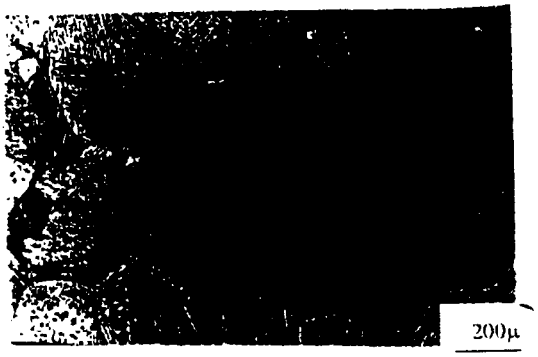
Figure 3:
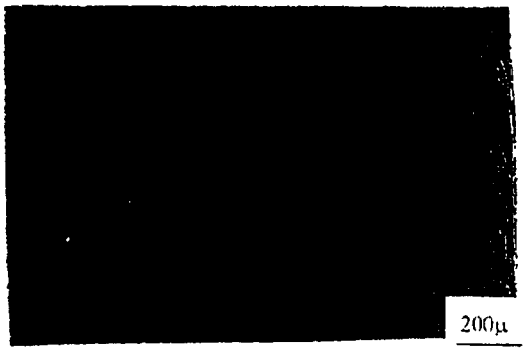
Figure 4:
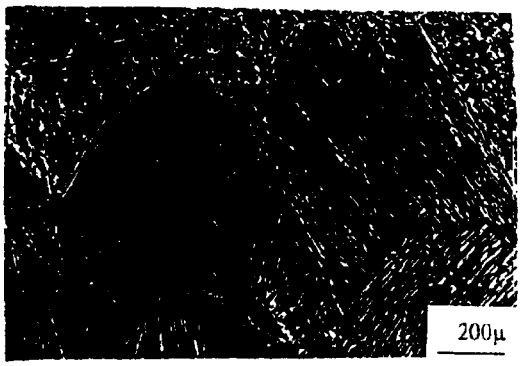
FIG. 4 Shows microstructures of seven more betatised samples, reheated (rebetatised) at 550° C., 575° C. 600° C., 625° C., 650° C., 675° C., 700° C. (increments of 25° C.) for ten minutes and cold water (room temperature) quenched.
Figure 4:
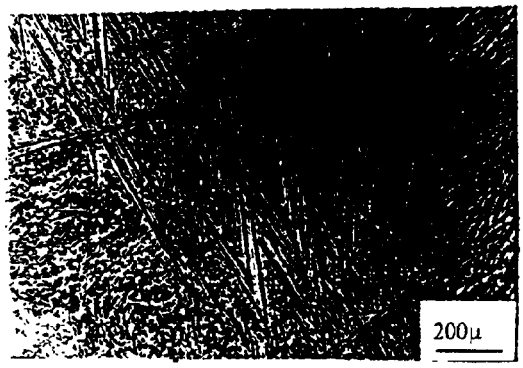
Figure 4:
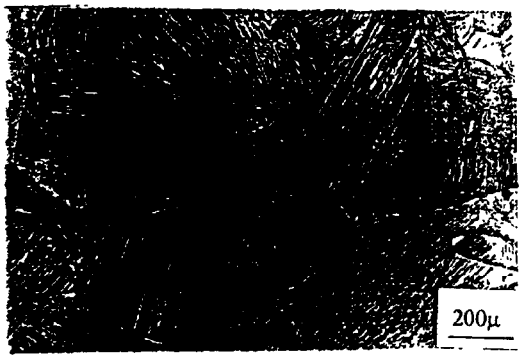
Figure 4:
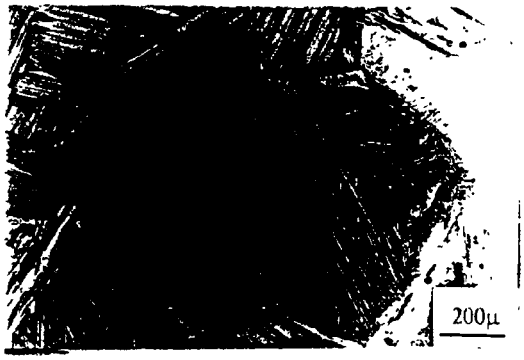
Figure 4:
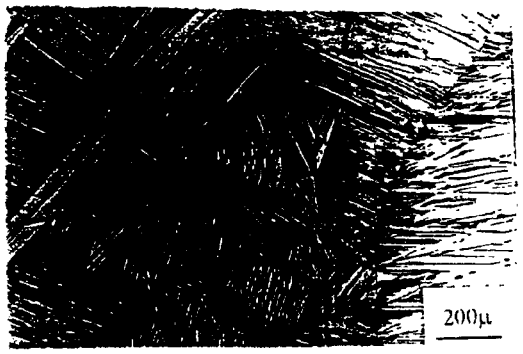
Figure 4:
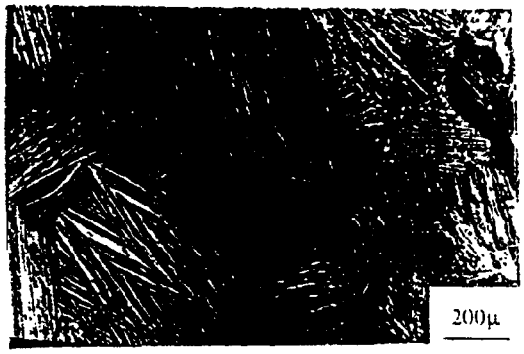
Figure 4:
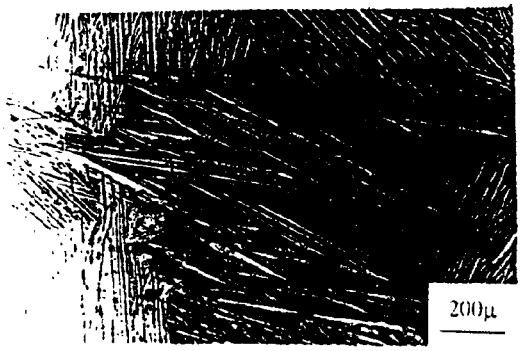

The charge consisting of commercially pure Copper, Zinc & Aluminum was melted in an induction furnace under a charcoal cover and cast into sand moulds in plates of sizes 150×100×12.5 mm. These were then homogenized at 800° C. for two hours and cooled. These were then surface machined to remove oxidized layer. These homogenized plates were analyzed for chemical composition. The plates (12 mm thick) were reheated at 750° C. for one hour and hot rolled down to one-mm thick flat sheets with number of reheating in-between the reduction passes. These sheets were held in fixtures (1.0-mm thick sheets) and were betatised at 750° C. for 3 minutes and then cold (ordinary) water quenched. These were trimmed to desired dimensions, approximately, 20–25 pieces of size 100 mm×10–12 mm×1 mm. From one flat sheet (betatised strip) a small rectangular piece (10×10 mm) was cut and mounted in a acrylic compound, polished on grades of silicon carbide papers then on diamond paste impregnated microcloth rotating wheel, etched in potassium dichromate etchant and its micro structure was seen under the optical microscope. The structure was fully martensitic. On the remaining strip, shape memory response was seen by hot air blower. Transformation temperature was determined using hot & cold water and temperature indicator. Its Shape Memory response was good and transformation temperature was around 110° C.–112° C. (FIG. 1) Six more memorized (betatised) sheets were then heated at 200° C., 300° C. 400° C., 500° C., 600° C. & 700° C. for ten minutes & cold (ordinary) water quenched. These were deformed to check the shape memory response and their microstructures were analyzed (FIGS. 2 & 3) The samples heated to 200° C., 300° C., 400° C. were very stiff as such memory could 60 not be noticed. Sample heated at 500° C. was soft but without shape memory. Their microstructures were seen. Samples heated at 600° C. and 700° C. were soft and showed shape memory at low temperatures & high temperatures respectively. Their microstructures were also seen. Martensitic structure prevailed between 500° C. to 700° C. Thus seven more betatised samples were further reheated (rebetatised) at 550° C., 575° C., 600° C., 625° C., 650° C., 675° C., 700° C. (increments of 25° C.) for ten minutes and cold water (room temperature) quenched. Their microstructures were observed (FIG. 4) These were deformed and their S.M. response & transformation temperatures were determined (FIG. 5,6). A betatised sample, rebetatised at 575° C. for ten minutes and water quenched was martensitic with enough alpha at the grain boundaries & within the grains, showed good shape memory response and its transformation temperature (As) was around 30° C. An initial temperature of 110° C. was thus lowered to 30° C. by this two-step treatment, a drop of temperature of 80° C. by this process. Any intermediate transformation temperature can be achieved by selecting appropriate re-betatising temperature. The process of re-betatising was repeated number of times, to ascertain the reproducibility and for the confirmation of results.

Example 2

In the Cu—Zn binary phase diagram Higgins R. A, Engineering metallurgy Vol. 1(1971), P-312–339, alpha solid phase (α) exists up to 39% zinc content. This α-phase has face centered cubic structure (FCC). It is ductile, malleable and cold workable. Above 39% Zinc to 50% zinc content a beta phase (β) appears. It has body centered cubic structure (BCC). It is a hard phase and can only be hot worked. Above 50% zinc content a complex, brittle and undesirable gamma γ phase structure is formed. Cu—Zn—Al is a ternary alloy system. It is basically a Cu—Zn alloy system with an addition of $3^{rd}$ element Aluminum. The zinc equivalent of Aluminum is six that is. 1% Aluminum has an effect similar to 6% zinc (1Al=6Zn) West E. G. Copper & its alloys (1982), P-98–105. We can thus calculate the equivalent of zinc for the shape memory alloy of composition (74.4% Cu-19.5% Zn-6.1% Al) by applying the following formula Greaves R. H. & Wrighton H., Practical Microscopical Metallography (1971), P-159–177. The equivalent of Zinc is calculated to be ~43%.

$$\text{Equivalent of Zinc} = \frac{\%\text{ of Zn} + 6 \times \%\text{ of Al} \times 100}{\%\text{ of Cu} + \%\text{ of Zn} + 6 \times \%\text{ of Al}}$$

If we examine the binary diagram of Cu—Zn System, the 43% Zinc content lies very close to or almost on the phase boundary regions of α and β i.e. in the β rich, regions of the diagram. Keeping in view their conditions relevant experiments were carried out. On heating, the alloy to 750° C. the structural transformation is from martensite to beta, as such, we will designate this heating treatment as betatising and the transformation temperature as As (while heating) & Ms (while cooling) respectively. The betatised material (750° C./3 min./CWQ) was soft & fully martensitic with a good SM response. Its temperature was 110° C. to 112° C. The previously high temperature betatised samples (6 Nos.) were rebetatised at low temperature to 200° C., 300° C., 400° C., 500° C., 600° C. and 700° C. for ten minutes and cold water (room temperature) quenched. Their microstructures, shape memory response and martensitic transformation temperatures were determined. Rebetatised 200° C. material was martensitic. But was very stiff, as quenching from 200° C. and as such did not show shape memory. Rebetatised 300° C. sample had α+β little martensite. It was stiff and had no memory. The morphology of a was rod or plate type. Rebetatised 400° C. sample too was stiff with no SME. It contained α+β structure and α-Phase was within the grains. The rebetaised 500° C. material was soft but had no SME. Its structure was α+β+ very little martensite. It had very thin α-phase rim at the grain boundaries, which had tendency towards globular form. The samples heated at 600° C. and 700° C. were soft and deformable and showed memory of low & high temperatures respectively. These materials were fully martensitic but 600° C. rebetatised sample had little α-precipitated at the grain boundaries and within the grains as compared to 700° C. sample. The 700° C. sample was comparatively fine grained. These materials did not crack even on cold water quenching. By these specific experiments it was ascertained that shape memory effect in this material was between 550° C. to 700° C. Thus, for further experiment seven betatised strips were taken and were subjected to re-betatising treatments at 550° C., 575° C., 600° C., 625° C., 650° C. 675° C. and 700° C. (an increment of 25° C.) for ten minutes and then cold (room temperature) water quenched. Microstructures, shape memory response, and transformation temperatures were evaluated. The 550° C. betatised sample was soft and its transformation temperature had dropped from 110° C. to 22° C. The sample had a feeble memory mainly because of separation of sufficient volume fraction of α-phase in β and very little visible martensite. Grain boundary α-envelop was also thick. Sample rebetatised at 575° C. was soft and had good shape memory 30° C. Its microstructure was martensitic with enough volume fraction of α phase-streaks at the grain boundaries and within the grain. α-Phase had tendency towards globular or lenticular shape formation. The precipitation of α-phase from the matrix has enriched the remaining beta phase in zinc content & shifted the composition towards right in binary diagram. This zinc rich beta on quenching transforms to zinc rich martensite and thus lowers the martensitic transformation temperature considerably i.e. from 110° C. to 30° C. a drop of 80° C. On re-betatising at 600° C. the material was soft with good SME and the transformation temperature was around 45° C. The sample was fully martensitic with little α-phase precipitated at grain boundaries & within the interior of grains. Samples rebetatised at 625° C. was also soft and has good SME around 61° C. Structure was martensitic with unresolved α-phase at the grain boundaries. The sample rebetatised at 650° C., 675° C. and 700° C. were all soft and had shape memory at 79° C., 100° C. & 110° C. respectively (FIG. 7,8). These were fully martensitic and there was hardly any a visible at grain boundaries & within the grains. In other wards α-phase was not resolvable. Since very little or negligible α-phase has separated from the martensite matrix, these samples showed shape memory at high temperatures. The results, therefore, indicate that the sample rebetatised at 575° C. gave an optimum value i.e. its martensitic transformation temperature was around 30° C. i.e. a drop of As from 110° C. to 30° C. which is a drop of 80° C. by this particular re-betatising treatment.

Example 3

Cu—Zn—Al Shape Memory alloys (4% Al & 6% Al)

(a) 74.4% Cu-19.5% Zn-6.1% Al (Melt No. 7) BETATISED (As): 110° C., REBETATISED (As): 30° C.

(b) 74.1% Cu-19.5% Zn-6.4% Al (Melt No. 5) BETATISED (As): 130° C., REBETATISED (As); 50° C.

(c) 73.6% Cu-20.2% Zn-6.2% Al (Melt No 6) BETATISED (As): 83° C., REBETATISED (As)-10° C.

(d) 71.0% Cu-24.8% Zn-4.2% Al (Melt No35) BETATISED (As): 65° C., REBETATISED (As): 45° C.

Example 4

It is observed that in Cu—Zn—Al (6%) shape memory alloys lowering of martensite transformation temperature is substantial i.e. 70° C.–80° C. It is also observed during experimentation that martensitic transformation temperature could be raised by 15° C.–20° C. by incorporating a bias or by suitable thermal treatment for the selective etching/loss of Zinc.

Martensite transformation temperature (As) can be lowered substantially by about 80° C. in Cu—Zn-6% Al alloys by specific thermal treatment i.e. by low temperature re-betatising of the previously high temperature betatised material. The decrease of temperature was mainly due to the separation of small quantities of alpha (α) from the matrix of martensite. This retained α-phase does not affect the shape memory response but in turn, it assists in cushioning the grain boundaries & thereby preventing the material from cracking, even on quenching in cold water.

ADVANTAGES OF THE INVENTION (1) In Cu—Zn-4% Al alloy Adnyana D. N., Wire Journal International, (1984), P-52–61, lowering of martensitic transformation temperature has been comparatively low i.e. around 20° C.–25° C. whereas in Cu—Zn-6% Al Shape memory alloys it was found to be substantial i.e. 70° C.–80° C.

(2) The present improved process has no adverse effect on shape memory response, recovery, fatigue life etc. rather the precipitation of α-phase in the martensite phase assists in cushioning the matrix and generally associated with shape memory alloys.

(3) The present improved process is likely to assist, the small & medium scale melting units, to accept the risks and challenges faced, in the melting of shape memory alloys by way of savings in the form of cost, manpower and machinery.

(4) The process is novel, simple & needs no additional manpower or equipment.

(5) Cold water quenching gives better shape memory response.

What is claimed is:

1. A shape memory alloy having a lowered martensitic transformation temperature by about 80° C. from said alloy's initial martensitic transformation temperature, said alloy comprising Copper and Zinc in the range of 62–86% of Copper and 10–28% of Zinc along with 6% of Aluminum and prepared by a process comprising the following steps of:

(i) selecting an alloy comprising Copper and Zinc in the range of 62–86% of Copper and 10–28% of Zinc along with 6% of Aluminum;

(ii) melting alloy composition in an induction furnace operating in air under charcoal cover followed by casting into desired shapes;

(iii) homogenizing the above composition at 800° C. for a period of about two hours followed by cooling;

(iv) surface machining for removing oxide scale formation;

(v) analyzing the alloy composition (vi) re-heating the shaped material at about 575° C. for about three minutes;

(vii) quenching said material with cold water;

(viii) obtaining a fully martensitic structure;

(ix) identifying the soft shape memory material with martensitic structure; and (x) recording the temperature and structure of the material.

2. A shape memory alloy as claimed in claim 1, wherein said alloy displays good shape memory at a re-betatising temperature of about 575° C.

3. A shape memory alloy as claimed in claim 1, wherein said alloy has good fatigue properties thereby preventing quench cracking.

4. A shape memory alloy as claimed in claim 1, wherein said alloy has good shape memory response properties.

* * * * *